United States Patent [19]

Ballarin

[11] 4,007,604

[45] Feb. 15, 1977

[54] REFRIGERATOR UNIT, PARTICULARLY DUAL TEMPERATURE REFRIGERATOR

[75] Inventor: Jürgen Ballarin, Giengen, Germany

[73] Assignee: Bosch-Siemens Hausgeräte GmbH, Stuttgart, Germany

[22] Filed: Feb. 18, 1976

[21] Appl. No.: 658,896

[30] Foreign Application Priority Data

Feb. 18, 1975 . Germany ..... 2506750

[52] U.S. Cl. ..... 62/174; 62/503

[51] Int. Cl.[2] ..... F25B 41/00; F25B 43/00

[58] Field of Search ..... 62/174, 503

[56] References Cited

UNITED STATES PATENTS

| | | | |
|---|---|---|---|
| 2,518,587 | 8/1950 | Zearfoss, Jr. | 62/503 |
| 2,539,908 | 1/1951 | Jenkins | 62/503 |
| 2,677,242 | 5/1954 | Grimshaw | 62/174 |
| 2,805,555 | 9/1957 | Schumacher | 62/503 |
| 2,942,434 | 6/1960 | Moore | 62/174 |
| 3,434,299 | 3/1969 | Nussbaum | 62/503 |
| 3,950,961 | 4/1976 | Lotz | 62/174 |

*Primary Examiner*—Lloyd L. King
*Attorney, Agent, or Firm*—Herbert L. Lerner

[57] ABSTRACT

In a dual temperature refrigerator with a single compressor from which refrigerant flows through a condenser and a capillary tube into a first evaporator, and from the first evaporator through a connecting line into a second evaporator, a refrigerant collector being connected to the condenser at the beginning of the capillary tube, the collector having a volumetric capacity equal to that of the second evaporator and being provided with a heater, a control element in the chamber of the second evaporator intermittently activating the compressor and heater, a suction line from the second evaporator to the compressor, and at least part of the capillary tube in heat-exchange contact with the connecting line. Preferably part of the capillary tube is disposed within the connecting line. Desirably the capillary tube and connecting line are disposed in the insulation of the refrigerator. The invention avoids unwanted drastic temperature drops in the chamber of the second evaporator due to overflowing excess liquid and wet vapor from the first evaporator.

3 Claims, 2 Drawing Figures

Fig.1
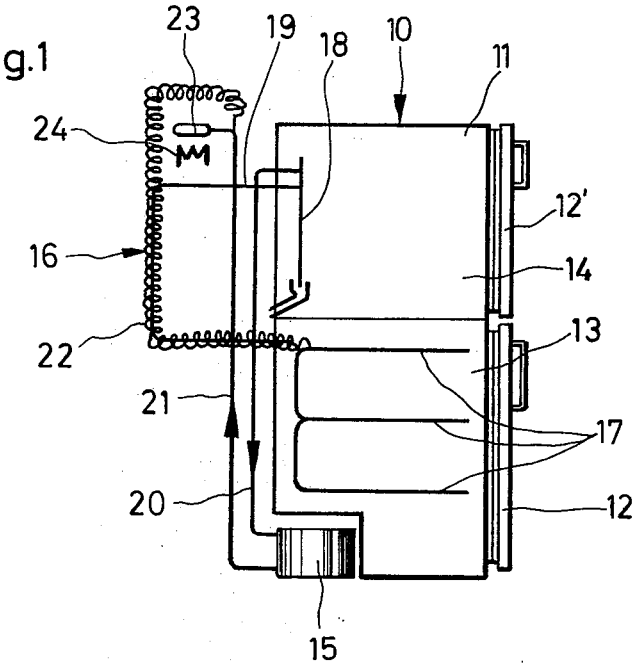
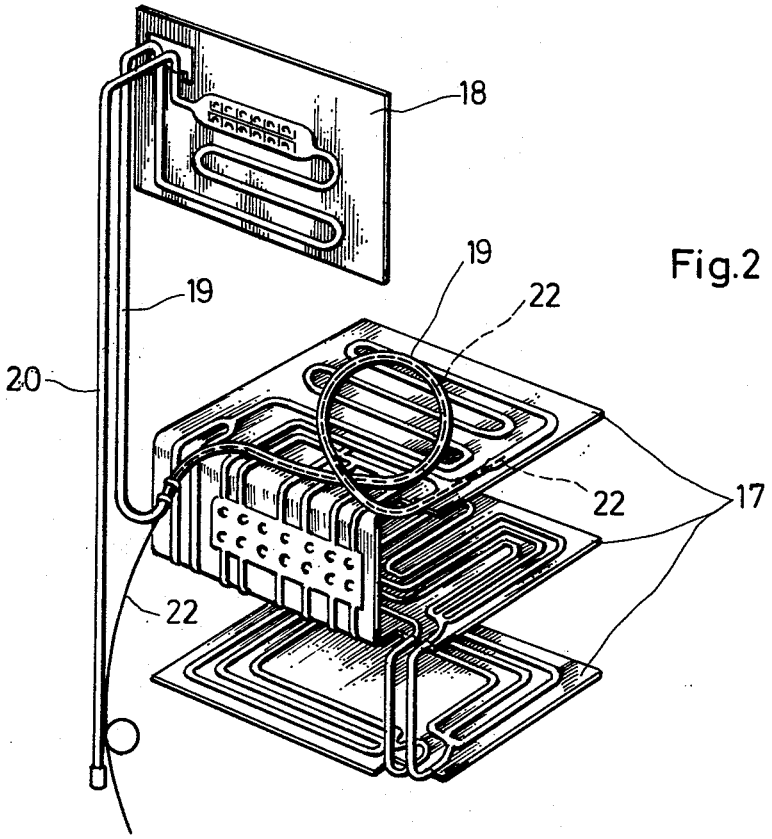
Fig.2

REFRIGERATOR UNIT, PARTICULARLY DUAL TEMPERATURE REFRIGERATOR

This invention relates to a refrigeration unit and more particularly refers to a new and improved dual temperature refrigerator.

A dual or two temperature refrigerator has a heat insulated housing and a refrigeration machine driven by a single compressor having a refrigeration cycle provided with a condensor, a refrigerant metering capillary and refrigerant transfer lines with at least two evaporator sections which are disposed in series in the flow path of the refrigerant, one of the evaporator sections being associated with a colder compartment i.e. a deep freeze compartment, and the second with a warmer compartment i.e. a regular cooling compartment. Two control elements are dependent on the temperatures in the colder and the warmer compartment, respectively, the one dependent on the warmer compartment intermittently activating the compressor, and simultaneously activating a heating element for a refrigerant collector. The refrigerant which has a collector, volumetric capacity that equals that of the second evaporator, is disposed before the capillary refrigerant metering device. When the heater is switched on, liquid refrigerant is discharged from the refrigerant collector by evaporation, thereby causing the liquid refrigerant in the first evaporator to flow over and simultaneously fill the second evaporator section.

The operating principle and characteristic of known refrigerators of the kind described are based on a determined amount of refrigerant which, in one case, fills only the evaporator of the deep freeze compartment. In another case, an additional volume of liquid refrigerant is discharged by the heating of the refrigerant collector, causing the first evaporator to overflow and fill the following evaporator of the regular cooling compartment when, in the latter case, the compressor plant is turned on in response to the control element of the warmer compartment. Activation of the compressor depends on the temperature in the regular cooling compartment.

A refrigeration system of this type is very sensitive to the filling level, inasmuch as the filling level must be, in the first case, between the two evaporators because only the evaporator of the deep freeze compartment is filled with liquid refrigerant, whereas the evaporator of the regular cooling compartment is not.

Therefore, with such cooling systems it is very difficult to compensate for the differences of the amount of refrigerant filling which results from the tolerances in volume of the evaporators and refrigerant pipe lines. This is particularly so when pressurewelded expanded passageway panels are used as evaporators. Because of the usual manufacturing tolerances in such assemblies, the difference of the passageway volumes between assemblies can possibly vary by an amount in terms of refrigerant which is the required amount of refrigerant to fill the passageway volume of the following evaporator in the regular cooling compartment. A reliable mass production of such refrigerators with little or no tolerances at manufacture, could only be assured by application of considerable cost-increasing manufacturing methods.

An object of the present invention is to minimize or eliminate difficulties in the function of a refrigeration system of a dual refrigerator due to manufacturing and assembly tolerances of evaporators and refrigerant pipe lines.

In accordance with the present invention there is provided a refrigeration unit, particularly a dual temperature refrigerator, with a heat insulated housing and a refrigeration machine driven by a single compressor having a refrigeration cycle provided with a condensor, a refrigerant metering capillary and refrigerant transfer lines with at least two evaporator sections disposed in series in the flow path of the refrigerant of which two evaporator sections the first is associated with a colder compartment and the second with a warmer compartment, a connecting coolant line which connects said first evaporator section with said second evaporator section, a control element dependent on the temperature in said warmer compartment, intermittently activating said compressor and which control element simultaneously activates a heating element for a refrigerant collector, which latter is disposed before said refrigerant metering capillary and from which said refrigerant collector, additional liquid refrigerant is discharged into and through said refrigerant metering capillary causing the first evaporator to overflow and thence flow into said first evaporator section when said heating element is switched on by said control element, and disposing at least a part of said metering capillary in heat conducting contact with said connecting coolant line which connects said first evaporator section with said second evaporator section.

Thus in accordance with the invention means are provided compensating for differences in volumetric capacity due to manufacturing tolerances by having at least a part of the capillary refrigerant metering device in heat-exchanging or heat conducting contact with the coolant line which connects the first with the second evaporator section.

Due to the heat exchange between the capillary tube and refrigerant line which connects two series-connected evaporators, during the periods when the compressor unit is not working, inflowing excess refrigerant from the evaporator of the deep freeze compartment, as liquid or wet vapor, is heated and evaporated. This prevents refrigerant in liquid form from entering the evaporator section of the regular cooling compartment to cause therein an undesired great temperature decrease.

In another embodiment of the invention the capillary metering device is disposed within refrigerant tube which connects the two evaporator sections. In this manner, very good heat exchange takes place between the metering capillary and the refrigerant carried in the refrigerant line.

In a further feature of the present invention, the refrigerant line which connects the two evaporator sections with the capillary metering device is disposed most of its length within the heat insulation of the refrigerator.

Other features which are considered as characteristic for the invention are set forth in the appended claims.

Although the invention is illustrated and described herein as embodied in refrigerator unit, particularly dual temperature refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a schematic side view of a dual temperature refrigeration unit with a refrigeration machine driven by a single compressor unit having two evaporator sections connected in series.

FIG. 2 shows a simplified perspective view of the evaporator sections and their coolant lines.

Referring to FIG. 1, a refrigeration unit 10 is provided with a heat insulated housing 11, in which are disposed on top of each other, a deep freeze compartment 13 and a regular cooling compartment 14, with each compartment accessible through a respective door 12, 12'. The dual temperature refrigeration unit 10 has a refrigeration machine 16 driven only by a single compressor unit 15 and having two evaporator sections 17 and 18 disposed in series in the coolant circuit.

Of the two evaporator sections, the one designated 17 is associated with the deep freeze compartment 13 and the one designated 18 is associated with the regular cooling compartment 14. Both evaporator sections are connected with each other by a connecting line 19. The refrigeration machine 16 is furthermore provided with a suction line 20 which connects the second evaporator section 18 with the compression unit 15, a condenser 21 and with a capillary tube 22 which serves as a metering device. A refrigerant collector 23 provided with a heating element 24 is disposed between the condensor 21 and the beginning of the capillary tube 22. The volume of the refrigerant collector 23 is proportional to the volume of the tube system of the evaporator section 18 associated with the regular cooling compartment 14. The heating element 24 is energized simultaneously with the compressor circuit dependent on the temperature of the regular cooling compartment 14, will be explained hereinafter.

The capillary 22, over the greater part of its total length, is in good heat conducting with the connecting line 19 which connects the two evaporator sections 17 and 18. This heat conducting contact can be achieved by winding the capillary 22 around the connecting line 19, as indicated in FIG. 1, or the capillary 22 with the part that is attached to the evaporator 17 may be disposed inside the connecting line 19 which connects the evaporator sections 17 and 18. Ordinarily, placing about 50% to 90% of the total length of the capillary 22 in heat conducting contact with the connecting line 19 will be adequate to compensate for manufacturing tolerances.

If the compressor 15, in the described arrangement, is energized by means of a conventional control element, not shown, which responds to the temperature in the warmer, regular cooling compartment 14, the heating element 24 at the refrigerant collector 23 disposed at the beginning of the capillary 22 is simultaneously energized so that, at the start-up of the compressor 15 and as a result of the pressure rise due to the heat addition, the liquid refrigerant stored in the refrigerant collector 23 is almost instantaneously discharged. Thereby, the second evaporator section 18, associated with the regular cooling compartment 14, is filled with liquid refrigerant within a short time. Thus, shortly after start-up of the compressor 15, the full cooling power is available at the evaporator section 18. When the resulting temperature drop in the regular cooling compartment 14 has reached the threshold level of the control element, then the conventional control element is switchingly activated and interrupts the current flow of the compressor 15 and also of the heating element 24. As pressure drops in the collector 23, the latter will fill again with liquid refrigerant from the condenser 21 until it reaches its normal filling level. After the complete evaporation of the liquid refrigerant in the evaporator 18, the latter gets warmer by heat absorption, and its temperature rises above the freezing point, melting the frozen condensate which has formed on the surface of the evaporator 18 during the preceding cooling period. The water formed by the melting is ducted outside of the housing 11. When, during the following temperature rise in the regular cooling compartment 14, the upper switching point of the conventional control element is reached, a new cooling cycle is started by renewed turning-on of the compressor 15 and the heating element 24.

If the compressor 15 is energized, however, by means of the conventional control element which responds to the temperature in the freeze compartment 13, only the evaporator section 17 will receive refrigerant in liquid state, since the heating element 24 remains deenergized, no liquid refrigerant stored in the collector 23 will traverse this circuit. In this case, any liquid refrigerant which, as a result of a tolerance in volumetric capacity in the passageways of the evaporator section 17, may enter the connecting line 19 will be evaporated as a result of its heat conducting contact with the hot capillary refrigerant metering device. Even wet vapor, which otherwise might be drawn into the passageways of the evaporator section 18, will be dried so that there will be no lowering of the temperature in the regular cooling compartment 14 as long as the compressor 15 is energized only by the control element responding to the temperature in the freeze compartment 13.

In the described system, the capillary 22, contrary to the usual disposal in the suction tube, is placed in good heat-conducting contact with the connecting line 19 which connects the first evaporator section 17 with the second evaporator section 18. This particular arrangement has the purpose of compensating for tolerances in passageway volumes of the pressure-welded expanded panels and thereby removing the difficulties due to the sensitivity of the system with respect to the filling level. This occurs in the following way, that, at over-filling of evaporator section 17 associated with the freeze compartment 13, the excess coolant entering into the connecting line 19, either in liquid form or as wet vapor from the evaporator section 17, is heated by heat exchanged between the capillary 22 and the connecting line 19 so that no heat energy is withdrawn from the following evaporator section 18. The length of the heat exchange zone is so dimensioned that the amount of coolant which overflows in the extreme tolerance case, is heated. Yet, the resulting output decline in the deep freeze compartment 13, due to the heat addition, stays within narrow limits. If necessary, it can be compensated for by conventional means, for example, by a closer spacing of the tubes of the tube system in the evaporator section 17 of the deep freeze compartment 13 and/or a volume increase of the refrigerant stored in the refrigerant collector 23.

Tolerances in the amount of coolant discharged by heating refrigerant collector 23 and in the volume of the coolant tubes in the first evaporator section 17 are easily compensated for by means of a settling chamber in series with the second evaporator section 18, the settling chamber being in the form of a vapor dome with a waffle pattern.

In a case of minimum filling of the system, if no coolant is present in the form of liquid or wet vapor in the heat-exchange zone formed by the connecting line 19, then the heat, which is added through the capillary 22 by changing the position of the connecting line 19 in the deep freeze compartment 13, will have a slight influence on the freezing temperature in the deep freeze compartment 13. However, this is avoided when the exchange zone is placed as far as possible into the heat insulation of the housing 11.

There are claimed:

1. In a refrigeration unit with a heat-insulated housing and a refrigeration machine driven by a single compressor having a refrigeration cycle and provided with a condenser, a refrigerant metering capillary and refrigerant transfer lines with at least two evaporator sections disposed in series in the flow path of the refrigerant, the evaporator sections including a first section associated with a colder compartment and a second section associated with a warmer compartment, a connecting coolant line connecting said first evaporator section with said second evaporator section, a control element dependent on the temperature in said warmer compartment for intermittently activating said compressor, said control element being adapted simultaneously to activate a heating element for a refrigerant collector, said collector having a volumetric capacity equalling that of the second evaporator and being disposed before said refrigerant metering capillary, additional liquid refrigerant being dischargeable from said refrigerant collector into and through said refrigerant metering capillary and thence into said first evaporator section, when said heating element is switched on by said control element so as to cause the first evaporator to overflow and discharge liquid refrigerant from said first evaporator section into said second evaporator section, at least a part of said metering capillary being disposed in heat-conducting contact with said connecting coolant line connecting said first evaporator section with said second evaporator section.

2. Refrigeration unit according to claim 1 wherein said metering capillary is disposed within said connecting coolant line which connects said first and second evaporator sections.

3. Refrigeration unit according to claim 1 wherein said connecting coolant line connecting said first and second evaporator sections is disposed for the greater part of its length, together with said metering capillary, in the insulation of the housing of the refrigerator unit.

* * * * *